US008695730B2

(12) United States Patent
Clark et al.

(10) Patent No.: US 8,695,730 B2
(45) Date of Patent: Apr. 15, 2014

(54) SYSTEM AND METHOD FOR DRILLING MULTILATERAL WELLS USING MAGNETIC RANGING WHILE DRILLING

(71) Applicant: Schlumberger Technology Corporation, Sugar Land, TX (US)

(72) Inventors: Brian Clark, Sugar Land, TX (US); Jan S. Morley, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/674,635

(22) Filed: Nov. 12, 2012

(65) Prior Publication Data

US 2013/0075084 A1 Mar. 28, 2013

Related U.S. Application Data

(62) Division of application No. 12/100,511, filed on Apr. 10, 2008, now Pat. No. 8,307,915.

(51) Int. Cl.
*E21B 43/00* (2006.01)

(52) U.S. Cl.
USPC ..... 175/62; 166/245; 166/50; 166/52

(58) Field of Classification Search
USPC ..... 166/245, 50, 52, 117.5; 175/62, 61
See application file for complete search history.

(56) References Cited

U.S. PATENT DOCUMENTS

| | | | | |
|---|---|---|---|---|
| 2,890,019 | A | | 6/1959 | Arps |
| 4,323,848 | A | | 4/1982 | Kuckes |
| 4,443,762 | A | * | 4/1984 | Kuckes ..... 324/346 |
| 4,529,939 | A | | 7/1985 | Kuckes |
| 4,593,770 | A | | 6/1986 | Hoehn |
| 4,700,142 | A | | 10/1987 | Kuckes |
| 4,791,373 | A | | 12/1988 | Kuckes |
| 4,845,434 | A | | 7/1989 | Kuckes et al. |
| 4,933,640 | A | | 6/1990 | Kuckes |
| 4,957,172 | A | | 9/1990 | Patton et al. |
| 5,074,365 | A | | 12/1991 | Kuckes |
| 5,131,477 | A | | 7/1992 | Stagg et al. |
| 5,218,301 | A | | 6/1993 | Kuckes |
| 5,258,755 | A | | 11/1993 | Kuckes |
| 5,305,212 | A | | 4/1994 | Kuckes |
| 5,323,856 | A | | 6/1994 | Davis et al. |

(Continued)

OTHER PUBLICATIONS

Press, et al., "Numerical Recipes in C: The Art of Scientific Computing, Second Edition", Cambridge University Press, Section 15.6, 1997, pp. 689-698.

(Continued)

*Primary Examiner* — Kenneth L Thompson
*Assistant Examiner* — Catherine Loikith
(74) *Attorney, Agent, or Firm* — Kimberly Ballew

(57) ABSTRACT

Systems and methods for drilling a multilateral well using magnetic ranging while drilling are provided. In accordance with one embodiment, a method of drilling a multilateral well includes drilling and casing a mother wellbore, installing a multilateral junction, drilling and casing a first lateral well from the multilateral junction, and drilling a second lateral well from the multilateral junction using magnetic ranging while drilling such that the second lateral well has a controlled relationship relative to the first lateral well. The first and second lateral wells may form a SAGD well pair, in which case the first lateral well may be a producer well and the second lateral well may be an injector well.

6 Claims, 7 Drawing Sheets

(56) References Cited

U.S. PATENT DOCUMENTS

| | | | | |
|---|---|---|---|---|
| 5,343,152 | A | 8/1994 | Kuckes | |
| 5,485,089 | A | 1/1996 | Kuckes | |
| 5,512,830 | A | 4/1996 | Kuckes | |
| 5,513,710 | A | 5/1996 | Kuckes | |
| 5,515,931 | A | 5/1996 | Kuckes | |
| 5,589,775 | A | 12/1996 | Kuckes | |
| 5,657,826 | A | 8/1997 | Kuckes | |
| 5,676,212 | A | 10/1997 | Kuckes | |
| 5,725,059 | A | 3/1998 | Kuckes et al. | |
| 5,785,133 | A | 7/1998 | Murray et al. | |
| 5,923,170 | A | 7/1999 | Kuckes | |
| 5,960,370 | A | 9/1999 | Towle et al. | |
| 6,026,914 | A | 2/2000 | Adams et al. | |
| 2002/0130663 | A1 | 9/2002 | Kuckes et al. | |
| 2003/0085059 | A1 | 5/2003 | Kuckes et al. | |
| 2003/0106686 | A1* | 6/2003 | Ingle et al. | 166/245 |
| 2003/0188891 | A1 | 10/2003 | Kuckes | |
| 2004/0040745 | A1 | 3/2004 | Kuckes | |
| 2005/0072567 | A1 | 4/2005 | Steele et al. | |
| 2005/0211469 | A1 | 9/2005 | Kuckes et al. | |
| 2006/0065441 | A1 | 3/2006 | Kuckes | |
| 2006/0066454 | A1 | 3/2006 | Kuckes et al. | |
| 2006/0113112 | A1 | 6/2006 | Waters | |
| 2006/0175061 | A1 | 8/2006 | Crichlow | |
| 2007/0016426 | A1 | 1/2007 | Hershey et al. | |
| 2007/0034384 | A1 | 2/2007 | Pratt | |
| 2007/0044957 | A1 | 3/2007 | Watson et al. | |
| 2007/0126426 | A1 | 6/2007 | Clark et al. | |
| 2009/0178850 | A1 | 7/2009 | Waters et al. | |

OTHER PUBLICATIONS

Walstrom, et al., "An Analysis of Uncertainty in Directional Surveying", Journal of Petroleum Technology, vol. 21, No. 4, Apr. 1969, pp. 515-523.

Williamson, H.S., "Accuracy Prediction for Directional Measurement While Drilling", SPE Drilling & Completion, vol. 15, No. 4, Dec. 2000, pp. 221-233.

Wolff, et al., "Borehole Position Uncertainty—Analysis of Measuring Methods and Derivation of Systematic Error Model", Journal of Petroleum Technology, vol. 33, No. 12, Dec. 1981, pp. 2330-2350.

International Search Report and Written Opinion of PCT Application No. PCT/US2009/035852 dated Jun. 7, 2013: pp. 1-9.

* cited by examiner

SYSTEM AND METHOD FOR DRILLING MULTILATERAL WELLS USING MAGNETIC RANGING WHILE DRILLING

CROSS-REFERENCE TO RELATED APPLICATIONS

This application is a Divisional of co-pending U.S. patent application Ser. No. 12/100,511, filed Apr. 10, 2008.

BACKGROUND OF THE INVENTION

The present invention relates generally to well drilling operations and, more particularly, to well drilling operations using magnetic ranging to drill multilateral wells.

Heavy oil is too viscous in its natural state to be produced from a conventional well. To produce heavy oil, a pair of Steam Assisted Gravity Drainage (SAGD) wells may be employed, which use superheated steam to heat heavy oil until its viscosity is low enough to be produced. A SAGD well pair includes two parallel horizontal wells which generally remain separated by an approximately constant vertical separation distance (e.g., 4 to 6 m) over a horizontal distance of roughly 500 m to 1500 m.

The upper well in a SAGD well pair is known as an "injector welt" The injector well injects superheated steam into a heavy oil zone formation, creating a steam chamber to heat the heavy oil contained therewithin. The lower well in a SAGD well pair is known as a "producer well." When the heated heavy oil becomes less viscous, gravity pulls the oil into the producer well below, from which the oil may be extracted.

Conventional measurement while drilling (MWD) survey data does not provide sufficient accuracy to maintain a consistent separation distance between the injector well and the producer well. Instead, conventional magnetic ranging may be employed to drill the second of the two wells of a SAGD well pair. With conventional magnetic ranging techniques, a wireline tool is placed in the first well while the second well is drilled. A magnetic field between the wireline tool in the first well and a bottom hole assembly (BHA) in the second well allows the BHA in the second well to maintain an accurate vertical separation distance between the first and second wells of the SAGD pair.

To reduce environmental impact at the surface, and for economic reasons, many non-SAGD wells employ a single mother wellbore having one or more multilateral junctions. The multilateral junctions allow multiple lateral wells to extend from the mother wellbore beneath the surface, which may increase oil recovery while reducing costs. However, multilateral junctions cannot be used with SAGD wells drilled using conventional magnetic ranging techniques. Since conventional magnetic ranging techniques involve placing a wireline tool into the first well of a SAGD well pair while the second well is drilled, the wireline associated with the wireline tool would be present alongside the drill pipe in the mother well. As such, the wireline could become wrapped around or crushed by the drill pipe, and cuttings from the second well could enter the first well and trap the wireline tool.

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In accordance with one embodiment of the invention, a method of drilling a multilateral well includes drilling and casing a mother wellbore, installing a multilateral junction, drilling and casing a first lateral well from the multilateral junction, and drilling a second lateral well from the multilateral junction using magnetic ranging while drilling such that the second lateral well has a controlled relationship relative to the first lateral well. The first and second lateral wells may form a SAGD well pair, in which case the first lateral well may be a producer well and the second lateral well may be an injector well.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

One or more specific embodiments of the present invention are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
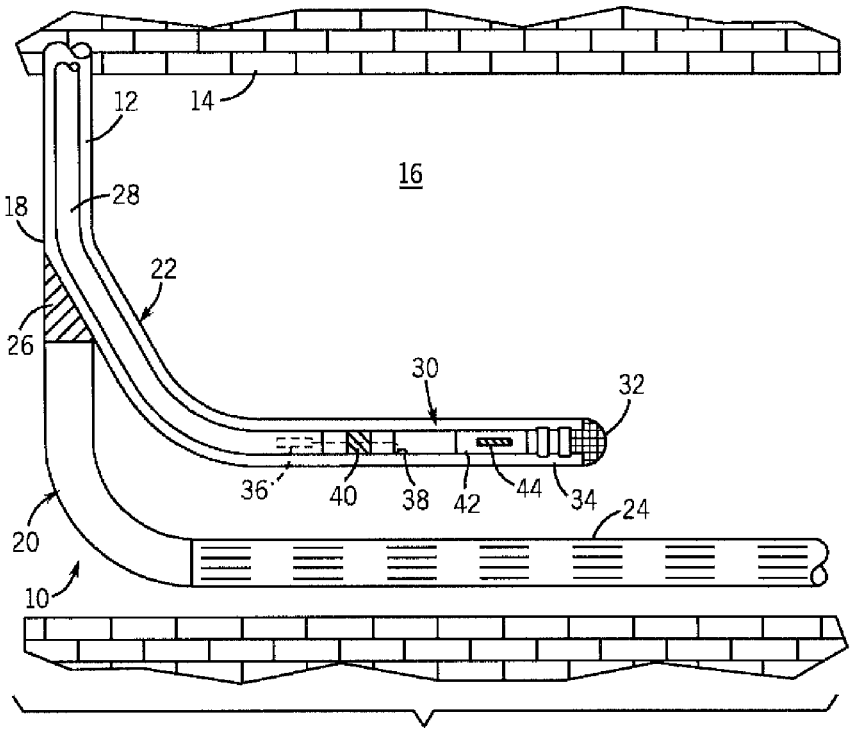
FIG. 1 is a schematic diagram depicting a multilateral well drilling operation in accordance with one embodiment of the invention.

FIG. 1 depicts a well drilling operation 10 involving drilling a multilateral well using magnetic ranging while drilling. A mother wellbore 12 extends through a formation 14 into a heavy oil zone formation 16. A multilateral junction 18 allows a Steam Assisted Gravity Drainage (SAGD) well pair, which includes a producer well 20 and an injector well 22, to branch from the mother wellbore 12 at the base of the heavy oil zone formation 16.

In the well drilling operation 10 of FIG. I., the producer well 20 has been drilled and cased with slotted liner 24, which allows oil to enter the producer well 20 while protecting the producer well 20 from collapse. To drill the injector well 22, a whip stock and packer 26 has been inserted into the multilateral junction 18 at the site of the multilateral junction 18. The whip stock and packer 26 guide a drill pipe 28 having a bottom hole assembly (BHA) 30 through the multilateral junction 18 away from the mother wellbore 12. Additionally, as cuttings from the injector well 22 are circulated out, the whipstock and packer 26 prevent the cuttings from falling into the producer well 20.

The BHA 30 includes a drill bit 32 for drilling through the heavy oil zone formation 16 and a steerable system 34 to set the direction of the drill bit 32. The BHA 30 includes an electric current driving tool 36, which may be a component of a measurement while drilling (MWD) tool or a standalone tool, such as Schlumberger's E-Pulse™ or E-Pulse Express™ tool. The electric current driving tool 36 provides an electric current to an outer drill collar 38 of the BHA 30. The outer drill collar 38 is separated from the rest of the drill pipe 28 by an insulated gap 40 in the drill collar, through which electric current may not pass. The BHA 30 additionally includes a magnetometer tool 42 having a three-axis magnetometer 44. The three-axis magnetometer 44 is employed in a technique known as magnetic ranging while drilling, which is described below. It should be noted that the BHA 30 may also include logging while drilling (LWD) tools, telemetry tools, and/or other downhole tools for use in a drilling environment.

Figure 2:
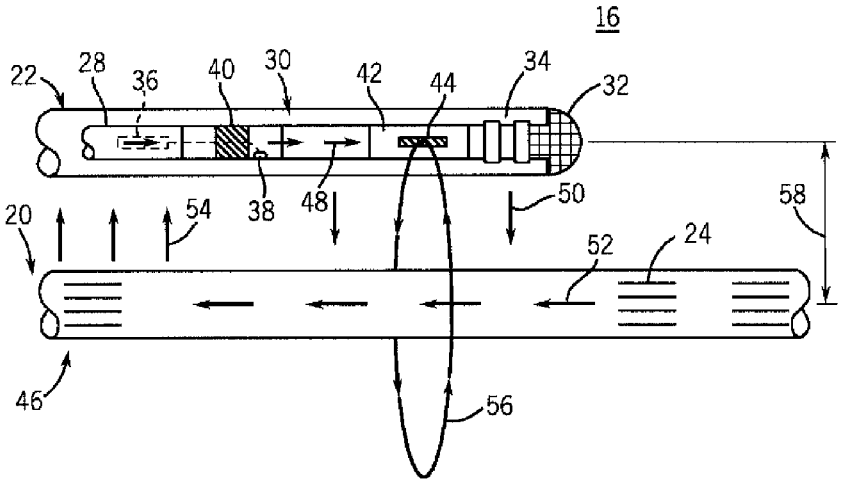
FIG. 2 is a schematic diagram illustrating the use of magnetic ranging while drilling in the multilateral well drilling operations of FIG. 1.

Turning to FIG. 2, a schematic of well drilling operation 46 illustrates the use of magnetic ranging while drilling to drill the injector well 22 at an approximately constant vertical separation distance from the producer well 20 in accordance with exemplary embodiments of the present invention. Without need for a separate wireline tool, magnetic ranging while drilling allows the BHA 30 to maintain a precise distance from the previously cased producer well 20. Though an overview of magnetic ranging while drilling is discussed below, a detailed description of magnetic ranging while drilling is available in published application US 2007/016426 A1, assigned to Schlumberger Technology Corporation, which is incorporated herein by reference.

To ascertain a vertical separation distance from the producer well 20 using magnetic ranging while drilling, the electric current driving tool 36 first provides an electric current 48 to the outer drill collar 38. The current 48 produced by the electric current driving tool 36 may, for example, have a frequency between about 1 Hz and about 100 Hz, and may have an amplitude of around 17 amps. Beginning along the outer drill collar 38 of the BHA 30, the current 48 may subsequently enter the heavy oil zone formation 16. The portion of the current 48 that enters the heavy oil zone formation 16 is depicted as an electric current 50.

The slotted liner 24 of the producer well 20 provides very low resistance to electricity as compared to the heavy oil zone formation 16, being typically six orders of magnitude lower than the resistance of the heavy oil zone formation 16. As a result, a substantial portion of the current 50 will pass along the slotted liner 24, depicted as a current 52, rather than travel elsewhere through the heavy oil zone formation 16. The current 52 travels along the slotted liner 24 before re-entering the heavy oil zone formation as current 54 on its way toward completing the circuit beginning at the electric current driving tool 36, located on the opposite side of the insulated gap 40 from the start of current 48.

The movement of the current 52 along the slotted liner 24 creates a magnetic field 56, an azimuthal magnetic field centered on the slotted liner 24. The three-axis magnetometer 44 of the magnetometer tool 42 may detect both the magnitude and the direction of the magnetic field 56 along three axes. The magnitude and direction of the magnetic field 56 may be used to estimate the direction and distance from the BHA 30 of the producer well 20. Having determined the direction and distance from the producer well 20, the BHA 30 may be controlled to drill the injector well 22 at an approximately constant separation distance 58 from the producer well 20 over the entire length of the producer well 20 and the injector well 22. For example, the precision available with magnetic ranging while drilling may permit a controlled relationship between the producer well 20 and the injector well 22, such that the approximately constant separation distance 58 approaches five meters (5 m) with a variance of approximately one meter (1 m) (i.e., a separation distance of 4-6 meters (m) along the entire length of the producer well 20).

Figure 3:
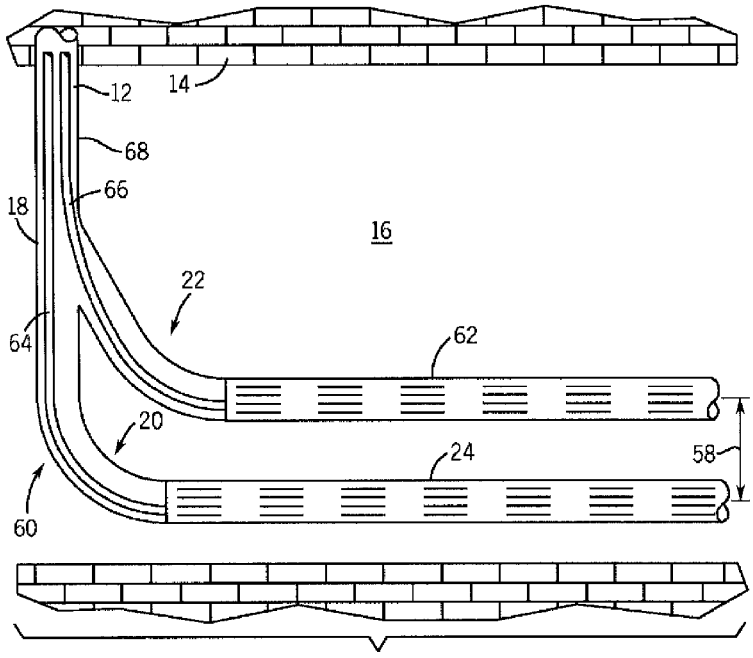
FIG. 3 is a schematic diagram depicting a completed multilateral well drilled using the multilateral well drilling operation of FIG. 1.

FIG. 3 depicts a completed multilateral SAGD well 60, In the completed multilateral SAGD well 60, the producer well 20 is cased with slotted liner 24, which allows oil to enter the producer well 20 while protecting the producer well 20 from collapse. The injector well 22, located directly above and parallel to the producer well at the approximately constant separation distance 58, is cased with slotted liner 62 to permit steam to exit the injector well 22 while protecting the injector well 22 from collapse. It should be appreciated that slotted liner may not be the only form of casing that is used on the producer well 20 and the injector well 22. The completed multilateral SAGD well 60 may also include producer tubing 64 and injector tubing 66. The producer tubing 64 is used to transport heavy oil that enters the producer well 20 up to the surface, and the injector tubing 66 is configured to carry steam generated at the surface down into injector well 22.

The mother wellbore 12 may have casing with thermal insulation 68. The insulation 68 reduces the amount of heat loss to the formations 14 and 16 from steam traveling from the surface toward the injector well 22 through the injector tubing 66. Additionally, the insulation 68 may also reduce the amount of heat loss to the formations 14 and 16 by the heated heavy oil in the producer tubing 64. Since heavy oil grows substantially more viscous as it cools, preventing the produced heavy oil from cooling may reduce lifting costs incurred to lift more viscous oil.

It should also be noted that by using a single mother wellbore 12, the completed multilateral SAGD well 60 may have a reduced footprint and environmental impact. In certain regions, such as arctic regions like Alaska, a large number of well penetrations at the surface could damage the permafrost. Morever, significant heat could be lost as steam is delivered to depths which may approach more than one thousand feet, and the produced oil in producer tubing 64 could have cooled, increasing lifting costs resulting from increased viscosity. Since the completed multilateral SAGD well has only a single mother wellbore 12, the surface area of the casing that is exposed to the surrounding formations 14 and 16 is minimized, reducing the total likely heat loss. Further, thermal insulation may be more cost-effective than with conventional SAGD wells, as only the mother wellbore 12 is insulated instead of than two conventional wells.

Figure 4:
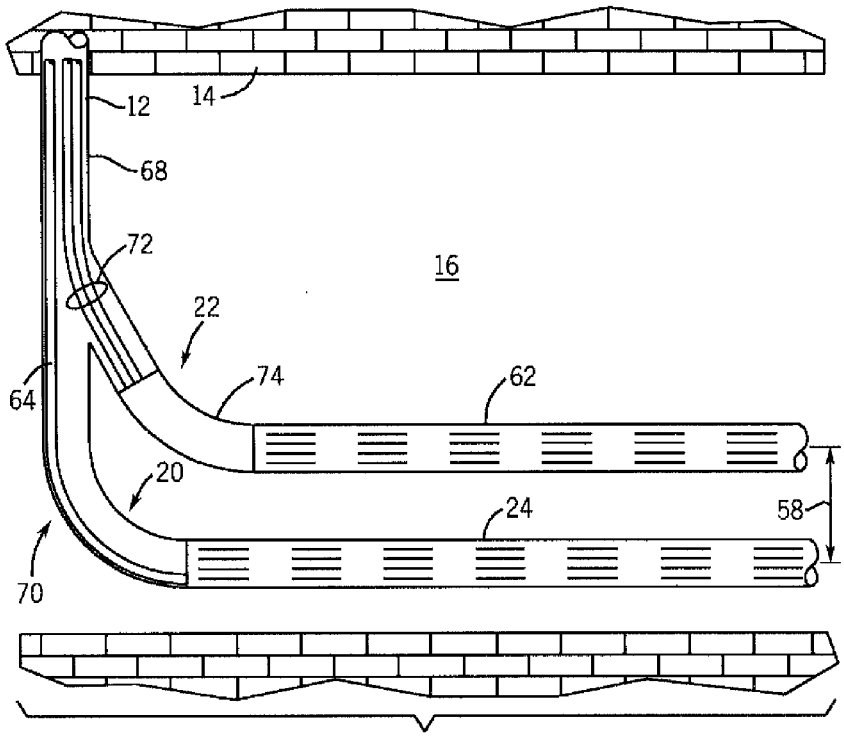
FIG. 4 is a schematic diagram depicting a completed multilateral well drilled using the multilateral well drilling operations of FIG. 1 having an in-well steam generator in accordance with another embodiment of the invention.

FIG. 4 depicts a completed multilateral SAGD well 70, completed in a similar fashion to the completed multilateral SAGD well 60, but configured to generate steam for the injector well 22 downhole in accordance with another embodiment of the present invention. In the completed multilateral SAGD well 70, as in the completed multilateral SAGD well 60 above, the producer well 20 is cased with slotted liner 24, which allows oil to enter the producer well 20 while protecting the producer well 20 from collapse. The injector well 22, located directly above and parallel to the producer well at the approximately constant separation distance 58, is cased with slotted liner 62 to permit steam to exit the injector well 22 while protecting the injector well 22 from collapse, The completed multilateral SAGD well 70 may also include producer tubing 64, which is used to transport heavy oil that enters the producer well 20 up to the surface.

Rather than employ injector tubing to transport steam generated at the surface into the injector well, the completed multilateral SAGD well 70 generates steam in the injector well at the base of the mother wellbore 12. Steam generation tubing 72, which includes tubing for oxygen, fuel and water, may supply a steam generator 74, The steam generator 74 may then produce the steam necessary to perform SAGD production operations at the injector well 22.

Figure 5:
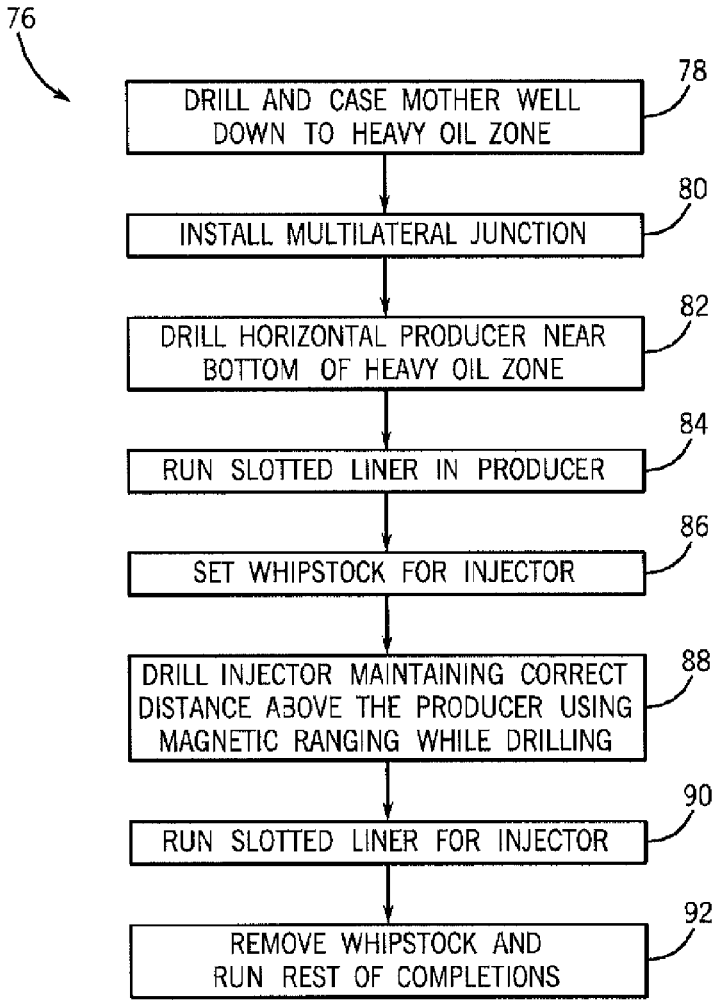
FIG. 5 is a flowchart describing a method of performing the multilateral well drilling operation of FIG. 1.

Turning to FIG. 5, a flow chart 76 depicts a method of drilling the multilateral wells depicted in FIGS. 1-4. In a first step 78, the mother wellbore 12 is drilled down into the heavy oil zone 16. Subsequently, the mother wellbore 12 is cased. In step 80, a multilateral junction 18 is installed. The multilateral junction 18 may be any appropriate multilateral junction, but may most likely be a level 5 or a level 6 multilateral junction. Such multilateral junctions may include Schlumberger's RapidX™ or RapidSeal™ multilateral junctions. In step 82, the horizontal producer well 20 is drilled near the base of the heavy oil zone 16. In step 84, the slotted liner 24 is installed in the producer well 20.

To begin drilling the injector well 22, in step 86, the whipstock and packer 26 are set in the multilateral junction 18. In step 88, the injector well 22 is drilled as the BHA 30 and drill pipe 28 are guided by the whipstock and packer 26 through the multilateral junction 18. The injector well is drilled maintaining a correct distance above the producer well 20 using magnetic ranging while drilling. Thus, with magnetic ranging while drilling, an approximately constant separation distance 58 may be maintained between the parallel producer well 20 and the injector well 22. In step 90, the injector well 22 is cased with slotted liner 62. In step 92 the whipstock and packer 26 is removed and the remaining completions are run, resulting in the completed multilateral SAGD well 60 or the completed multilateral SAGD well 70.

Figure 6:
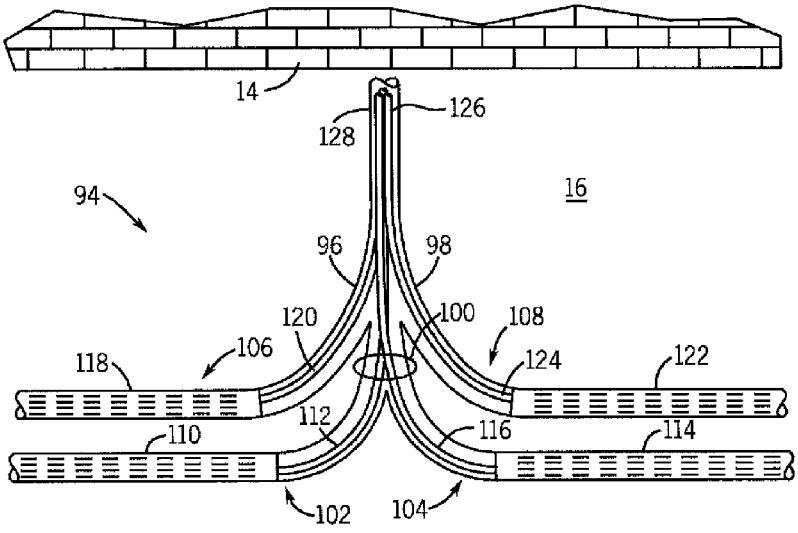
FIG. 6 is a schematic diagram depicting a multilateral well having multiple multilateral well pairs drilled in accordance with one embodiment of the invention.

FIG. 6 depicts a completed multilateral SAGD well 94, in which a plurality of multilateral SAGD wells share a single mother wellbore 126. In the completed multilateral SAGD well 94, a plurality of multilateral junctions 96, 98, and 100 may be installed near the base of the mother wellbore. It should be noted, however, that any number of multilateral junctions may be employed as necessary to achieve a desired multilateral SAGD well configuration.

The completed multilateral SAGD well 94 includes two producer wells 102 and 104 and two parallel injector wells 106 and 108. Producer well 102 is cased with slotted liner 110 and completed with producer tubing 112, and producer well 104 is cased with slotted liner 114 and completed with producer tubing 116. Similarly, injector well 106 is cased with slotted liner 118 and completed with injector tubing 120, and injector well 108 is cased with slotted liner 122 and completed with injector tubing 124. It should be appreciated, as noted above, that slotted liner may not be the only form of casing that is used on the producer wells 102 and 104 and the injector wells 106 and 108.

The mother wellbore 126 extends from the surface through the formation 14 into the heavy oil zone 16. To prevent unnecessary heat loss, the mother wellbore 126 may be insulated with insulation 128. As in the completed multilateral wells 60 and 70, the insulation 128 serves to reduce the amount of heat loss to the formations 14 and 16 from steam traveling from the surface to the injector wells 106 and 108 through the injector tubing 120 and 124. The insulation 128 may also reduce the amount of heat loss to the formations 14 and 16 by the heated heavy oil in the producer tubing 112 and 116. Additionally, because fewer wells will need to be drilled from the surface, the footprint and environmental impact of the completed multilateral SAGD well 94 may be reduced.

It should be appreciated that the completed multilateral SAGD well 94 may be modified to generate steam downhole, rather than at the surface, in a similar manner to that of the completed multilateral well 70 of FIG. 4. In such an embodiment, steam generation tubing for oxygen, fuel, and water may supply a downhole steam generator. The steam generator may then produce the steam for injection into the injector wells 106 and 108.

Figure 7:
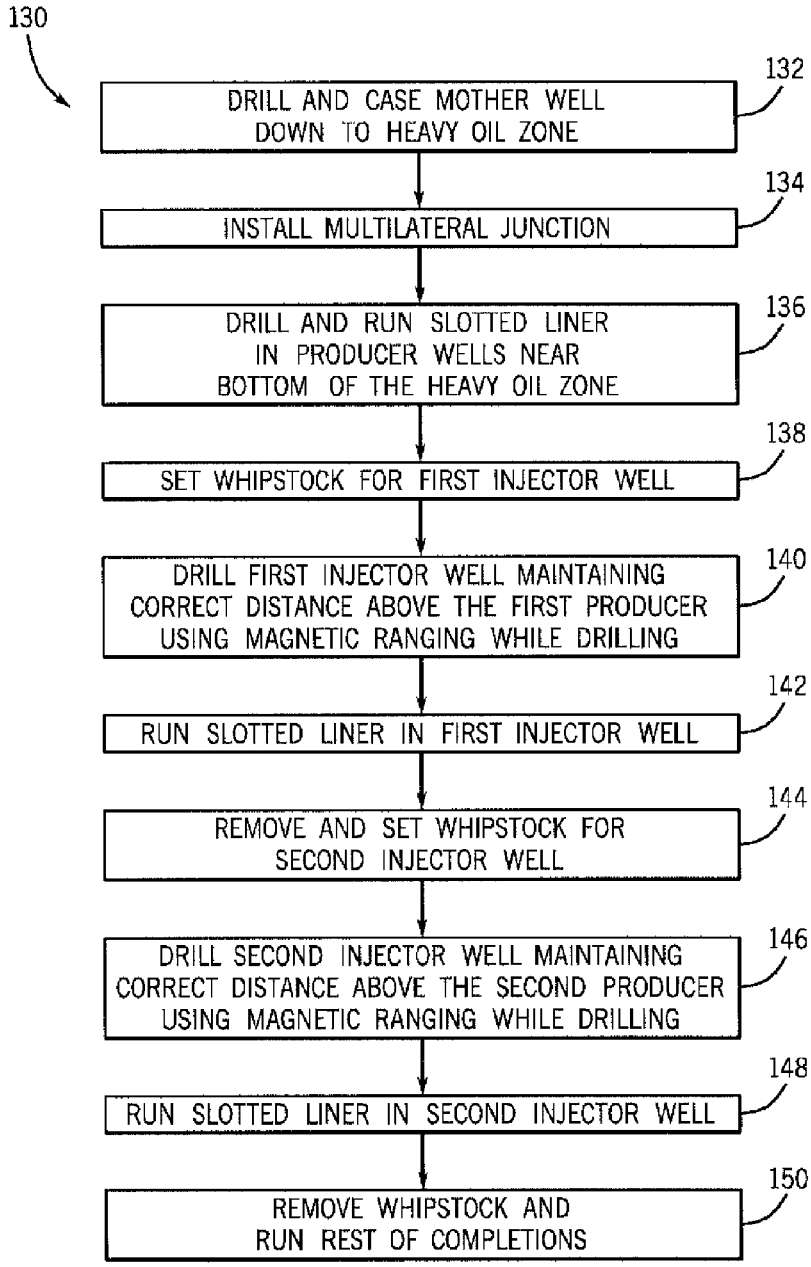
FIG. 7 is a flowchart describing a method of drilling the multilateral well of FIG. 6.

FIG. 7 depicts a flow chart 130 for drilling the completed multilateral SAGD well 94 of FIG. 6. In step 132, the mother wellbore 126 is drilled through the formation 14 into the heavy oil zone 16. In step 134, one or more multilateral junctions 96, 98 or 100 may be installed to achieve a desired multilateral configuration. The multilateral junctions 96, 98 and 100 may be any appropriate multilateral junctions, but may most likely be level 5 or level 6 multilateral junctions. Such multilateral junctions may include Schlumberger's RapidX™ or RapidSeal™ multilateral junctions.

Once the multilateral junctions 96, 98 or 100 are installed, the producer wells 102 and 104 are drilled and cased with slotted liner 110 and 114 near the base of the heavy oil zone 16 in step 136. With the producer wells 102 and 104 drilled and cased, the corresponding injector wells 106 and 108 may be drilled. In step 138, a whipstock and packer may be set for the first injector well 106. The first injector well 106 is drilled in step 140, employing magnetic ranging while drilling to maintain an approximately constant distance of separation between the injector well 106 and the producer well 102, using the techniques discussed above. In step 142, the slotted liner 110 is run in the first injector well 106.

To begin drilling the second injector well 108, the whipstock and packer may be removed from the first multilateral junction 96 and reset in step 144. In step 146, the second injector well 108 is drilled, employing magnetic ranging while drilling to maintain an approximately constant distance of separation between the injector well 108 and the producer well 104, After the slotted liner 122 is run in the second injector well in step 148, the whipstock and packer may be removed. In step 150, the remainder of the completions is run.

Figure 8:
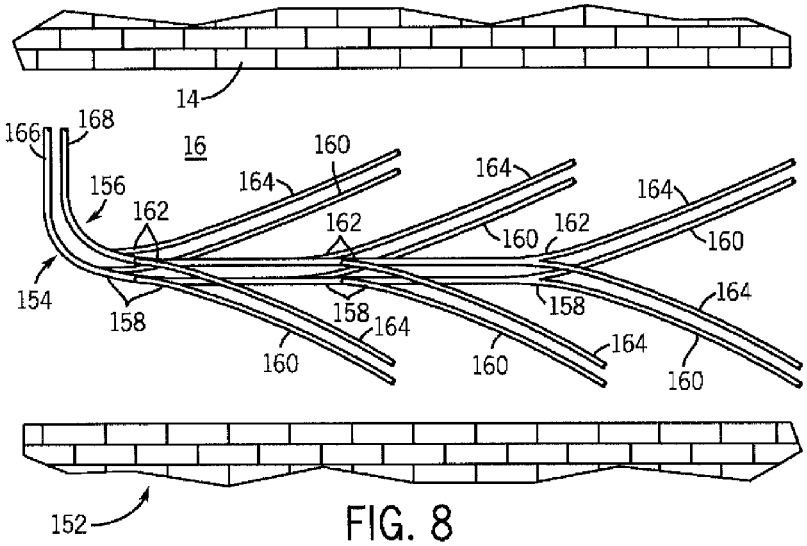
FIG. 8 is a schematic diagram depicting a pair of fishbone wells drilled in accordance with one embodiment of the invention.

FIG. 8 illustrates a SAGD fishbone well pair 152 which has been drilled using magnetic ranging while drilling. The SAGD fishbone well pair 152 includes a fishbone producer well 154 and a fishbone injector well 156. The fishbone producer well 154 includes a plurality of multilateral injunctions 158, providing branches for a plurality of lateral producer wells 160. Similarly, the fishbone injector well 156 includes a plurality of multilateral junctions 162 placed respectively above the multilateral junctions 158 of the fishbone producer well 154. Having such placement, a plurality of lateral injector wells 164 may be drilled directly above the lateral producer wells 160 at an approximately constant separation distance.

Provided that the fishbone producer well 154 has been cased with a conductive liner, the lateral injector wells 164 may each be drilled employing magnetic ranging while drilling to maintain an approximately constant separation distance above the respective lateral producer wells 160. It should be further noted that magnetic ranging while drilling may also be employed in drilling a vertical producer mother wellbore 166 parallel to a vertical injector mother wellbore 168 through the formation 14 into the heavy oil zone 16.

It should be appreciated that the fishbone injector well 156 may be modified to generate steam downhole, rather than at the surface, in a similar manner to that of the completed multilateral well 70 of FIG. 4. In such an embodiment, steam generation tubing for oxygen, fuel, and water may supply a downhole steam generator. The steam generator may then produce the steam for injection into the lateral injector wells 164.

Figure 9:
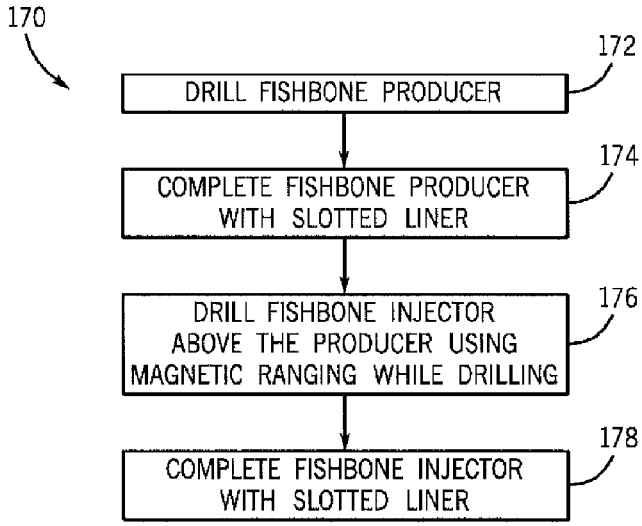
FIG. 9 is a flowchart depicting a method of drilling the pair of fishbone wells depicted in FIG. 8.

Turning to FIG. 9, a flow chart 170 illustrates a method of drilling the SAGD fishbone well pair 152 of FIG. 8. In step 172, the producer mother wellbore 166 is drilled down to the heavy oil zone 16, the plurality of multilateral junctions 158 is installed, and the lateral producer wells 160 are drilled. In step 174, the fishbone producer well 154 is cased in slotted liner. Additional completions may also be run, but may not be necessary at this time.

In step 176, the fishbone injector well 156 is drilled. Employing magnetic ranging while drilling, the horizontal portion of the injector mother wellbore 168 may be drilled at an approximately constant separation distance above the fishbone producer well 154. At each multilateral junction 162, corresponding respectively to multilateral junctions 158, the lateral injector wells 164 are drilled with magnetic ranging while drilling directly above the lateral producer wells 160. In step 178, the fishbone injector well 156 may be cased in slotted liner and completion subsequently run.

It should be appreciated that the above-discussed multilateral wells may include a number of modifications or variations, such that one lateral wellbore is spaced accurately apart from another respective wellbore, For example, any of the disclosed embodiments may additionally or alternatively include a parallel horizontal monitoring well drilled at an approximately constant horizontal, rather than vertical, separation distance, Moreover, the embodiments may be modified to accommodate VAPEX or ES-SAGD oil production techniques. The wells may also be completed with casing or liners, and be slotted or solid. Electric heaters, radio-frequency heaters, induction heaters or other heating means may be used in place of steam. Furthermore, parallel wells may be drilled from a mother borehole using multilateral junctions for producing conventional oil or natural gas, the parallel well bores being used for monitoring production, or injecting gas or water to aid production.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method for drilling a multilateral well comprising:

drilling and casing a mother wellbore in a subsurface formation;

installing a multilateral junction in the mother wellbore;

drilling and casing a first lateral well from the multilateral junction such that the first lateral well includes a liner;

drilling a second lateral well from the multilateral junction, using a bottom hole assembly having a drill bit, an electric current driving tool, and a magnetometer; and wherein drilling the second lateral well includes (i) causing the electric current driving tool to provide an electrical current that travels through the subsurface formation to the first lateral well and along the liner such that the current traveling along the liner creates a magnetic field, (ii) causing the magnetometer to measure the magnetic field, and (iii) magnetically ranging while drilling the second lateral well in a controlled relationship to the first lateral well using the magnetometer measurement.

2. The method of claim 1, wherein the controlled relationship between the first and second lateral wells is an approximately constant distance and spatial relationship.

3. The method of claim 2, wherein the separation distance of the second lateral well relative to the first lateral well varies by less than or equal to 20% along a length of the second lateral well.

4. The method of claim 1, wherein said drilling the second lateral well is accomplished such that the second lateral well is directly above the first lateral well.

5. A method of drilling a multilateral well comprising:

drilling and casing a mother wellbore in a subsurface formation;

installing a multilateral junction in the mother wellbore;

drilling and casing a first lateral well from the multilateral junction, wherein the first lateral well includes a liner and has a length of at least 500 meters;

drilling a second lateral well from the multilateral junction using a bottom hole assembly having a drill bit, an electric current driving tool, and a magnetometer, wherein drilling the second lateral well comprises maintaining a separation distance from the first lateral well having a variance of no greater than two meters over a length of at least 500 meters; and wherein drilling the second lateral well includes (i) causing the electric current driving tool to provide an electrical current that travels through the subsurface formation to the first lateral well and along the liner such that the current traveling along the liner creates a magnetic field, (ii) causing the magnetometer to measure the magnetic field, and (iii) magnetically ranging while drilling the second lateral well so as to maintain the separation distance using the magnetometer measurement.

6. The method of claim 5, wherein drilling and casing the first lateral well comprises drilling and casing a producer well, and wherein drilling the second lateral well comprises drilling an injector well; and wherein the method further comprises installing a steam generator in the injector well.

* * * * *